US007543709B2

(12) United States Patent
Bouthiette

(10) Patent No.: US 7,543,709 B2
(45) Date of Patent: Jun. 9, 2009

(54) SEALING SHEET FOR USE TO CLOSE A CONTAINER-DEFINING SHEET

(75) Inventor: Michel Bouthiette, Granby (CA)

(73) Assignee: 9155-0020 Quebec Inc., Granby (CA)

( * ) Notice: Subject to any disclaimer, the term of this patent is extended or adjusted under 35 U.S.C. 154(b) by 0 days.

(21) Appl. No.: 11/844,851

(22) Filed: Aug. 24, 2007

(65) Prior Publication Data

US 2008/0023366 A1 Jan. 31, 2008

Related U.S. Application Data

(63) Continuation-in-part of application No. 11/674,883, filed on Feb. 14, 2007, which is a continuation-in-part of application No. 11/416,274, filed on May 1, 2006, now Pat. No. 7,308,984.

(30) Foreign Application Priority Data

Mar. 3, 2006 (CA) ..... 2538623

(51) Int. Cl.
*B65D 83/04* (2006.01)

(52) U.S. Cl. ..... 206/532; 206/538

(58) Field of Classification Search ..... 206/528, 206/532, 534.1, 534.2, 536, 538, 531
See application file for complete search history.

(56) References Cited

U.S. PATENT DOCUMENTS 5,788,079 A 8/1998 Bouthiette et al.
5,944,191 A * 8/1999 Ray et al. ..... 206/532
5,975,304 A * 11/1999 Cain et al. ..... 206/467
6,021,623 A 2/2000 Bouthiette et al.
6,023,916 A 2/2000 Bouthiette et al.
6,026,726 A 2/2000 Bouthiette et al.
6,382,420 B1 5/2002 Bouthiette et al.
2006/0249421 A1 * 11/2006 Pham ..... 206/531
2006/0289328 A1 * 12/2006 Hession ..... 206/531

* cited by examiner

*Primary Examiner*—Jacob K Ackun, Jr.

(57) ABSTRACT

Disclosed is an improved sealing sheet for use to close a container-defining sheet having a top surface comprising a given number of spaced apart cavities embossed therein, each of the cavities being upwardly opened and thus defining a container that is surrounded by a flange that is part of the top surface of the container-defining sheet. This improved sealing sheet has a top layer with tearing lines punched therein in such a manner and position as to extend from one side of each cover piece that may be splitted from the sealing sheet to cover one of the cavities up to at least the adjacent corners of the bottom piece left on the corresponding cover piece. Such facilitates peeling of the bottom piece and of the corresponding part of the cover piece from the corresponding container to have access to the element(s) stored in it while preventing glue to be left on the flanges that surround the top opening of the container since such flanges are then still covered by non splitted parts of the sealing sheet.

20 Claims, 10 Drawing Sheets

SEALING SHEET FOR USE TO CLOSE A CONTAINER-DEFINING SHEET

CROSS-REFERENCE

The present application is a continuation-in-part of application Ser. No. 11/674,883, filed on Feb. 14, 2007, which is a continuation-in-part of application Ser. No. 11/416,274 filed on May 1, 2006, with the benefit of the priority of Canadian patent application no. 2,538,623 filed on Mar. 3, 2006.

BACKGROUND OF THE INVENTION

The present invention relates to an improved sealing sheet for use to close a plurality of containers formed in a container-defining sheet, especially but not exclusively for the storage of individual pills.

The invention also relates to a set of individual pill containers comprising a container-defining sheet made of plastic material and defining a plurality of individual pill containers closed by the above-mentioned improved sealing sheet.

BRIEF DESCRIPTION OF THE PRIOR ART

It is of common practice in the pharmaceutical field to prepare sets of individual containers containing pills and/or tablets to be administered to a patient. Each of these containers contains pills and/or tablets that the patient has to take together at the same time during the day over a given period of time (preferably one week).

To prepare such sets of individual pill containers for use by a patient, it is also of common practice to use a sheet of plastic material in which a plurality of cavities are embossed. Each of these cavities defines a small upwardly opened container that can be filled with pills. After filling, all the containers are closed by means of a sealing sheet on which all desirable indications can be printed, like the patient's name, the date and hour of administration, etc. As it can be understood, the indications are printed and formatted onto the sealing sheet so that each group of information referring to a given container is positioned in regard to said container. Tearing lines are provided on both the container-defining sheet and the sealing sheet to permit easy separation of the individual pill containers.

For further information as to the structure, manufacture and use of such sets of individual pill containers, reference can be made to U.S. Pat. No. 5,788,079 and its Canadian counterpart no. 2,207,045 which both name the present inventor, and to all the prior art references that were cited during their prosecution.

In practice, the sealing sheet used to close the containers of these known sets of individual pill containers can be made of plastic material and be thermosealed onto the container-defining sheet. Alternatively, as disclosed in the above mentioned US and Canadian patents naming the present inventor, the sealing sheet can be made of paper or similar material and be glued onto the container-defining sheet. For this purpose, the sealing sheet comprises a top layer having a lower surface covered with a pressure sensitive adhesive glue and a bottom layer having an upper surface detachably fixed to the lower surface of the top layer by means of the adhesive glue. The bottom layer is peelable from the lower surface of the top layer to allow fixation of it onto the top surface of the container-defining sheet. Advantageously, this bottom layer has tearing lines punched into it in such a manner and position as to leave parts of it glued onto the bottom surface of the top layer in the form of a number of bottom pieces equal to the given number of cavities made in the container-defining sheet when the sealing sheet is peeled off. Each of these bottom pieces are shaped, sized and positioned so as to extend over a corresponding cavity of the container-defining sheet when the sealing sheet is properly applied to and glued on the flanges of the top surface of the container-defining sheet. These bottom pieces thus prevent the pill(s) stored in each of the containers from coming into contact with the adhesive glue.

As another example of such a sealing sheet, reference can be made to U.S. Pat. No. 6,382,420 which also names the present inventor.

All of these existing sealing sheets are efficient. However, the way they are devised does not give easy access to each of the containers they close. Indeed, to do so, one must either break and/or pierce the portion of the sealing sheet that extends just on top of the container to be opened, or alternately, peel it off, such always leaving free at least some part of the flanges surrounding the top opening of the container, with glue still extending on them. In the latter case, it may then happen that the pill(s) come(s) into contact with this glue by accident, which is of course something that should be avoided. The fact that the flanges still have some glue on them also makes it possible to reclose the container by folding back the corresponding portion of the sealing sheet, which is once again something that must be avoided for security reason.

SUMMARY OF THE INVENTION

It has now been found that the above-mentioned problem of having easy, safe and clean access to the containers formed by the container-defining sheet sealed by a sheet as disclosed hereinabove, individual pill containers, can be solved by the improved sealing sheet disclosed and claimed hereinafter.

More specifically, the present invention is directed to an improved sealing sheet for use to close a container-defining sheet having a top surface comprising a given number of spaced apart cavities embossed therein, each of the cavities being upwardly opened and thus defining a container that is surrounded by a flange that is part of the top surface of the container-defining sheet.

As is of common practice, the sealing sheet comprising:

- a top layer having an upper surface and a lower surface, the lower surface being covered with a pressure sensitive adhesive glue; and
- a bottom layer detachably fixed to the lower surface of the top layer by means of the adhesive glue, the bottom layer being peelable from the lower surface of the top layer to allow fixation of the sealing sheet onto the top surface of the container-defining sheet in order to close the containers of the same.

As is also of common practice, the bottom layer of the sealing sheet has tearing lines punched into it in such a manner and position as to leave parts of the bottom layer glued onto the bottom surface of the top layer in the form of a number of bottom pieces equal to the given number of cavities made in the container-defining sheet when the sealing sheet is peeled off. Each of the bottom pieces is shaped, sized and positioned so as to extend over a corresponding cavity of the container-defining sheet when the sealing sheet is properly applied to and glued on the flanges of the top surface of the container-defining sheet. Thus, these bottom pieces prevent any element like pills stored in the containers from becoming into contact with the adhesive glue while they are stored.

In accordance with the invention as claimed, the above sealing sheet is improved in that its top layer has pairs of tearing lines punched therein, each of said pairs of tearing lines being adjacent to one of the cover pieces and having each of its tearing lines that extends from one side of the adjacent cover piece towards at least one adjacent corner of the bottom piece of this cover piece. Such facilitates peeling of the bottom piece and of the corresponding part of the cover piece from the corresponding container to have access to the element(s) stored in it. Such also causes the top layer to be splitted along the sides of the cover piece and thus to remain on the flanges that surround top opening of the corresponding container. As a result, the risk of contact of element(s) stored in the container with the glue that may be left on the flanges after removal of the bottom piece, is substantially reduced.

Optionally, the tearing lines of each pair of tearing lines extend further from the adjacent corners of the corresponding bottom piece along the opposite sides of this corresponding bottom piece. Such may facilitate the splitting of the top layer along the sides of the corresponding lower piece.

In accordance with a preferred embodiment of the invention, each of the flanges that are parts of the top surface of the container-defining sheet and are not directly adjacent to one side of the container-defining sheet, is provided with a centrally positioned tearing line so as to make it possible to separate each of the containers from the adjacent containers and thus from the container-defining sheet whenever desired. In such a case, the top layer of the sealing sheet also has tearing lines punched therein in such a manner and position as to be in line with the tearing lines of the container-defining sheet and thus to allow the top layer, once glued onto the flanges of the container-defining sheet, to be splitted into a number of cover pieces equal to the number of containers, such making it possible to detach each of the containers from the container defining sheet while keeping it closed.

In accordance with another preferred embodiment of the invention, the container defining sheet comprises recesses embossed therein so as to extend adjacent to the one side of each of the cover pieces from which extend the other tearing lines allowing peeling of the corresponding bottom piece from the corresponding container. The recesses are U-shaped so as to give easy access to a finger and thus facilitate such a peeling. In such a case, the tearing lines of the bottom layer of the sealing sheet are also devised to provide each of the bottom pieces with a small pulling tab projecting from one edge of the corresponding bottom piece in such a manner that, once the sealing sheet is glued on top of the container defining-sheet, the pulling tab extends at a short a distance away from the cavity of the corresponding container towards the adjacent recess embossed therein. Such, of course, facilitates again peeling of the bottom piece from the container.

Moreover, in this particularly preferred embodiment, the top layer of the sealing sheet further has additional tearing lines punched therein in such a manner as to extend toward the pulling tab along the edge of the bottom piece from where the pulling tab projects. These additional tearing lines thus extend transversally from the tearing lines that are in lines with the opposite side of the bottom piece along the edge of it, towards and up to the pulling tab.

Advantageously, the tearing lines of the bottom layer of the sealing sheet are devised so as to provide each of the bottom pieces with an extension opposite to the edge from which projects the pulling tab.

The invention is also directed to an improved set of individual pill containers of the type comprising:

a container-defining sheet made of plastic material, the container-defining sheet having a top surface comprising a given number of spaced apart cavities embossed therein, each of the cavities being upwardly opened and thus defining a container, each of the containers being surrounded by a flange, each of the flanges that are not directly adjacent to one side of the container-defining sheet being provided with a centrally positioned tearing line so to make it possible to detach each of the containers from the adjacent containers and thus from the container-defining sheet whenever desired, and a sealing sheet made of paper and positioned on top of the top surface of the containing-defining sheet in order to close each of the containers, the sealing sheet being shaped and sized to cover at least all its containers and their surrounding flanges, the sealing sheet being detachably attached to the container-defining sheet by means of a pressure sensitive adhesive glue and being provided with tearing lines positioned to be in superposition on top of the tearing lines of the container-defining sheet to make it possible to tear the sealing sheet into a number of cover pieces corresponding to the number of said containers and thus to detach each of the containers without having to open the same.

The sealing sheet used in this improved set comprises:

a top layer made of paper and having an upper surface and a lower surface, the lower surface being covered with the pressure sensitive adhesive glue; and a bottom layer detachably fixed to the lower surface of the top layer by means of the adhesive glue, the bottom layer being peelable from the lower surface of the top layer to allow fixation of the sealing sheet onto the top surface of the container-defining sheet in order to close the containers of the same.

This bottom layer has tearing lines punched into it in such a manner and position as to leave parts of said bottom layer glued onto the bottom surface of the top layer in the form of a number of bottom pieces equal to the given number of cavities made in the container-defining sheet when the sealing sheet is peeled off, each of the bottom pieces being shaped, sized and positioned so as to extend over a corresponding cavity of the container-defining sheet when the sealing sheet is properly applied to and glued on the flanges on the top surface of the container-defining sheet, such bottom pieces preventing any element stored in the containers from becoming into contact with the adhesive glue.

Once again, this set is improved as compared to the existing one in that the top layer of its sealing sheet has pairs of tearing lines punched therein, each of said pairs of tearing lines being adjacent to one of the cover pieces and having each of its tearing lines that extends from one side of the adjacent cover piece towards at least one adjacent corner of the bottom piece of this cover piece, in order to facilitate peeling of the bottom piece and of the corresponding part of the cover piece from the corresponding container and thus to have access to the element(s) stored in it.

Preferably again, the container-defining sheet comprises recesses embossed therein so as to extend adjacent to the one side of each of the cover pieces from which extend the tearing lines allowing peeling of the corresponding bottom piece from the corresponding container. These recesses are U-shaped so as to give easy access to a finger and thus facilitate such a peeling. The tearing lines of the bottom layer of the sealing sheet are also devised to provide each of the bottom pieces with a small pulling tab projecting from one edge of the corresponding bottom piece in such a manner that, once the sealing sheet is glued on top of the container defining-sheet, this tab extends at a short a distance away the cavity of the corresponding container towards the adjacent recess embossed therein, such facilitating again peeling of the bottom piece from the container. In this particular embodiment, the top layer of the sealing sheet advantageously has also additional tearing lines punched therein in such a manner as to extend toward the pulling tab along the edge of the bottom piece from where this pulling tab projects. These additional tearing lines thus extend transversally from the tearing lines that are in lines with the opposite side of the bottom piece along the edge of it, towards and up to the pulling tab.

Preferably also, the container-defining sheet of the above set comprises twenty-eight containers that are positioned to define seven rows and four columns. The sealing sheet is then devised to form a corresponding number of cover pieces that are each printed with relevant information as to the content of the corresponding containers and the date and hour the pills contained therein must be taken.

This invention and its numerous advantages will be better understood upon reading the following non restrictive description of a preferred embodiment thereof, made with reference to the accompanying drawings.

DESCRIPTION OF A PREFERRED EMBODIMENT OF THE INVENTION

Figure 1:
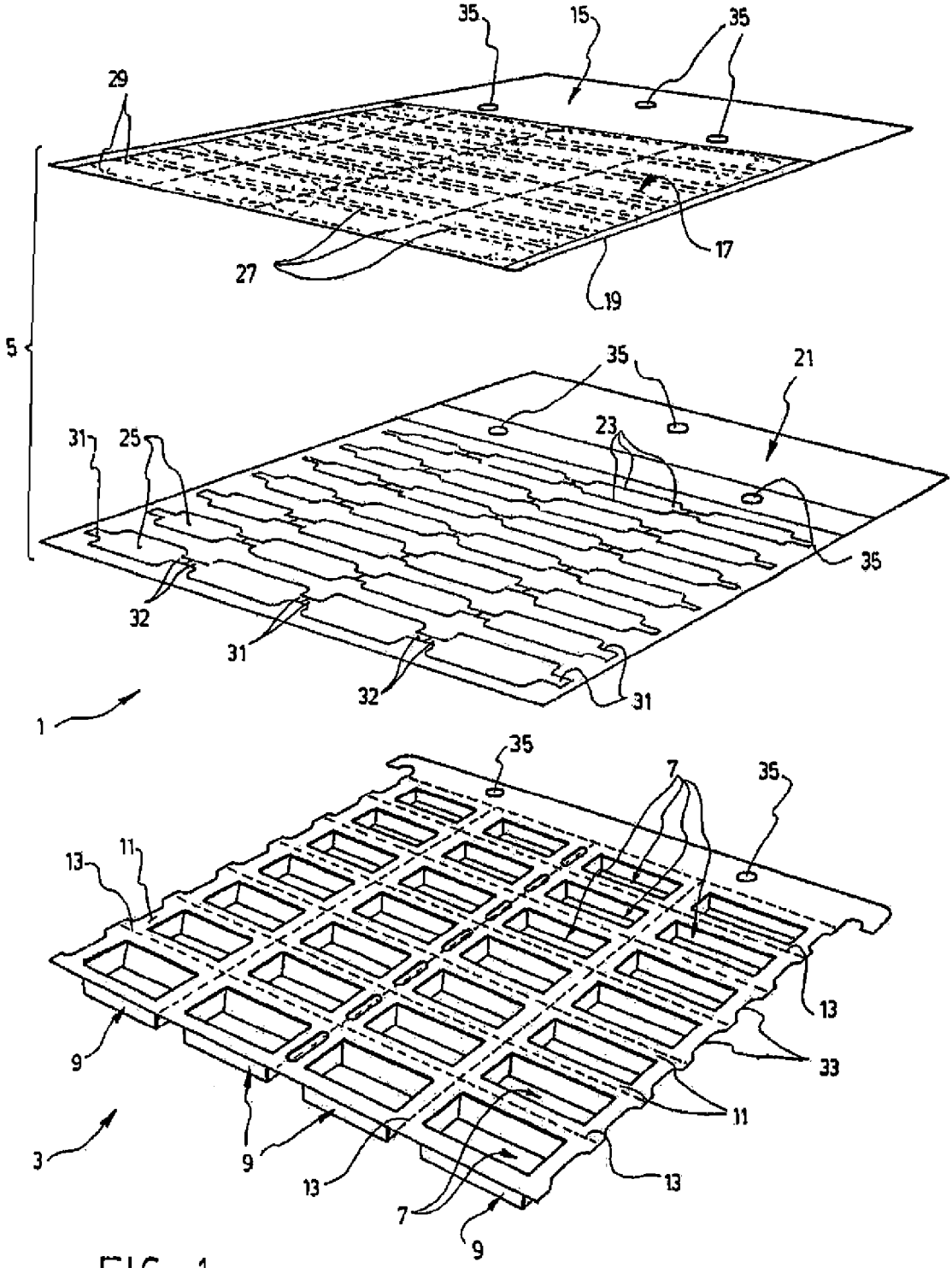
FIG. 1 is an exploded perspective view of an improved set of individual pill containers according to a preferred embodiment of the invention.

As indicated hereinabove, the present invention relates to an improvement made to the structure of a sealing sheet for use to seal a container-defining sheet like those especially devised to form sets of individual pill containers for use in pharmacies or hospitals. An exploded perspective view of such a set of individual pill containers according to a preferred embodiment of the invention is illustrated in FIG. 1. This set which is numbered 1 in the drawings, basically comprises a container-defining a sheet 3 and a sealing sheet 5 intended to be attached on top of the container-defining sheet 3.

The container-defining sheet 3 is preferably made of a plastic material and has a top surface comprising a given number of spaced apart cavities 7 embossed therein. Each cavity 7 is upwardly opened and thus defines a container 9 which is surrounded by a flange 11. Each of the flanges 11 which is not directly adjacent to one external side of the container-defining sheet 3 is provided with a centrally positioned tearing line 13 so as to make it possible to detach each of the containers 9 from all the adjacent containers and thus from the container-defining sheet 3 whenever desired.

The sealing sheet 5 is preferably made of paper and devised to be positioned on top of the top surface of the container-defining sheet 3 in order to close each of the containers.

Figure 5:
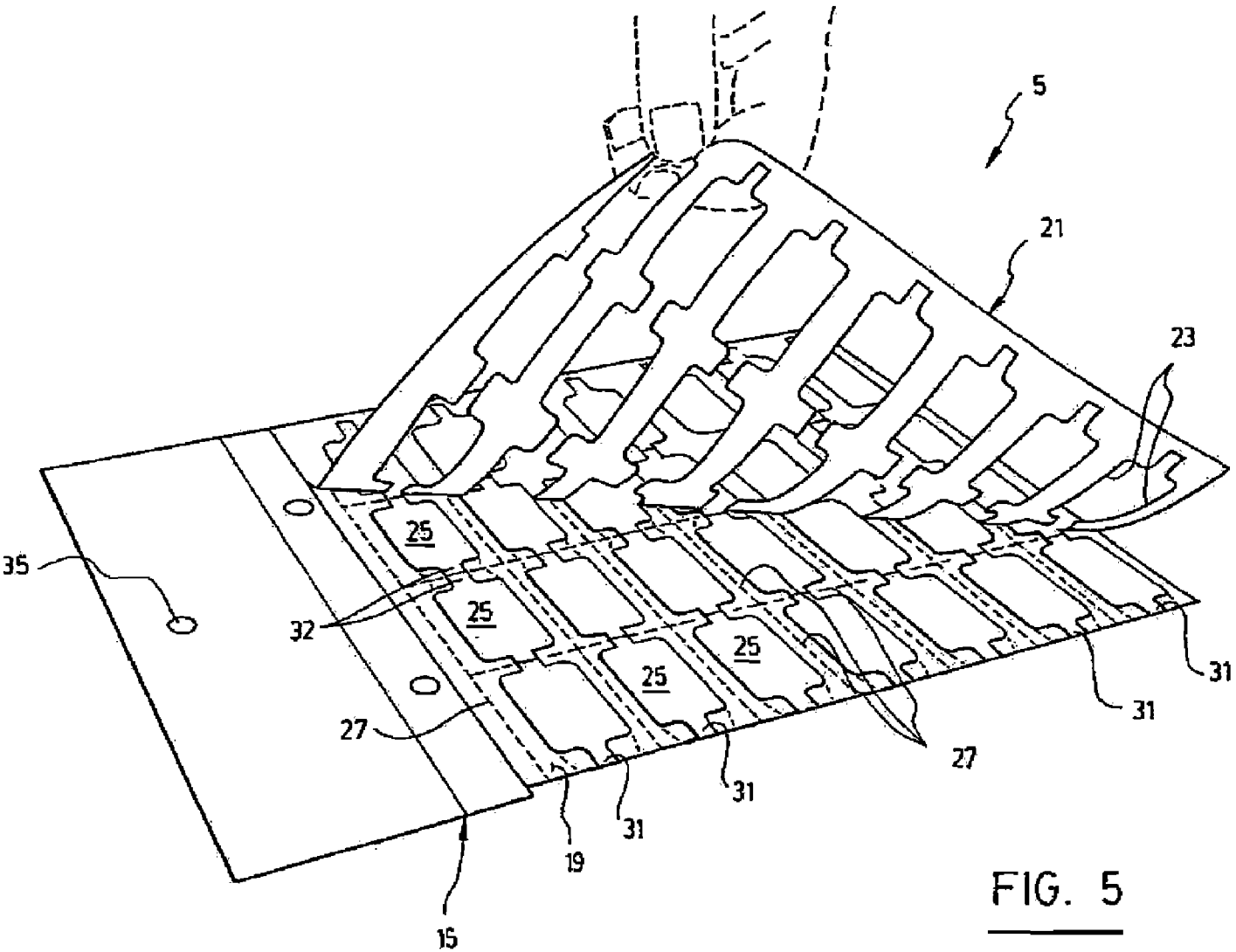
FIG. 5 is a perspective view showing how the bottom layer of the sealing sheet may be peeled off while leaving bottom pieces attached to the bottom surface of the top layer of the sealing sheet to close each of the containers.

The sealing sheet 5 comprises a top layer 15 which has an upper surface 17 and a lower surface 19 that is covered with a pressure-sensitive adhesive glue. The sealing sheet 5 also comprises a bottom layer 21 that is detachably fixed to the lower surface 19 of the top layer 15 by means of the adhesive glue. The bottom layer 21 is devised to be peelable from the lower surface 19 of the top layer 15 in order to allow fixation of the sealing sheet 5 on to the top surface of the container-defining sheet 3 in order to close all the containers 9 made in this sheet 3. The way the bottom layer 21 may be peeled off from the lower surface 19 of the top layer 15 is illustrated in FIG. 5.

Figure 4:
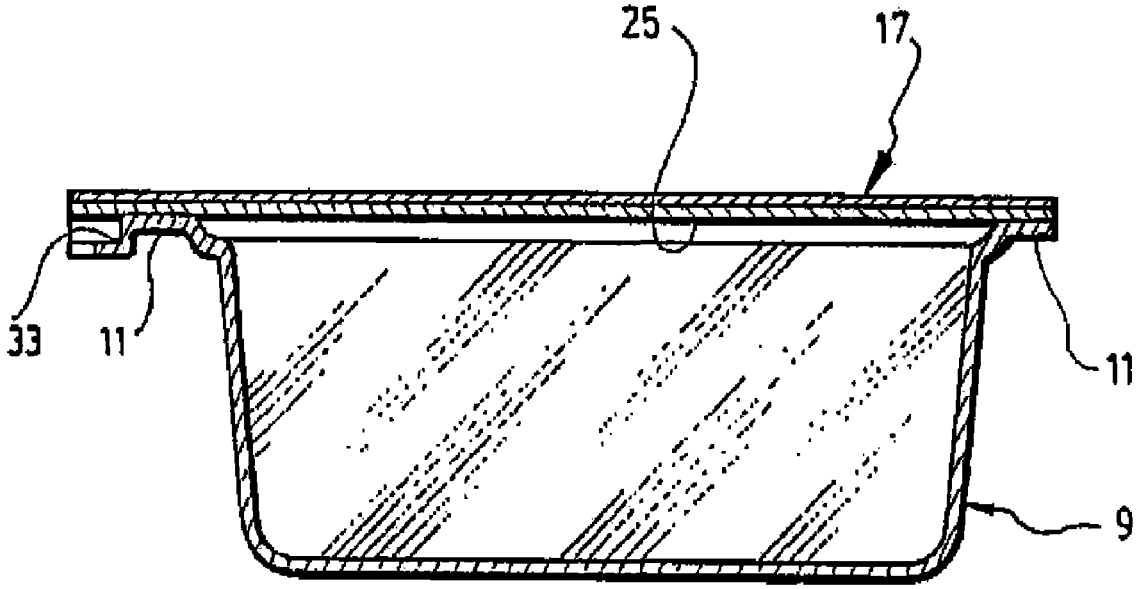
FIG. 4 is a side elevational view of the container shown in FIGS. 2 and 3, showing the sealing sheet in a closed position.

As is shown in FIGS. 1, 5, 6 and 12, the bottom layer 21 of the sealing sheet has tearing lines 23 that are punched into it in such a manner and position as to leave parts of the bottom layer 21 glued onto the bottom surface 19 of the top layer 15 in the form of a number of bottom pieces 25 equal to the number of cavities 7 made in the container-defining sheet 3 when the sealing sheet 5 is peeled off. Each of the bottom pieces 25 is shaped, sized and positioned so as to extend over a corresponding cavity 7 of the container-defining sheet 3 when the sealing sheet is properly applied to and glued on the flanges 11 located on the top surface of the container-defining sheet 3. As a result, these bottom pieces 25 prevent any element like pills stored in the containers 9, from coming into contact with the adhesive glue that was originally applied to all the adjacent surfaces of the top and bottom layers 15 and 21 of the sealing sheet 5. As to the particular position and protective effect of each of the bottom pieces 25, reference can be made to FIGS. 2 and 4 of the drawings.

Of course, when the container-defining sheet 3 is devised so as to allow each of its containers to be detached as was disclosed above and is illustrated in the drawings, the top layer 15 of the sealing sheet 5 must have tearing lines 27 punched therein in such a manner and position as to be in line with the tearing lines 13 of the container-defining sheet 3, in order to allow the top layer 15, once glued onto the flanges 11 on top of the container-defining sheet 3, to be splitted into a number of cover pieces 17 equal to the number of containers 9. Such is actually necessary to allow detachment of each of the containers 9 from the container-defining sheet 3 while keeping the so-detached containers closed.

In accordance with the present invention, the set 1 of individual pill containers disclosed hereinabove, is improved in that the top layer 15 of the sealing sheet 5 has pairs of tearing lines 29 punched therein, each of said pairs being adjacent to one of the cover pieces 17 and having each of its tearing lines 29 that extends from one side of the corresponding cover piece 17 towards one adjacent corner of the corresponding bottom piece 25.

Figure 2:
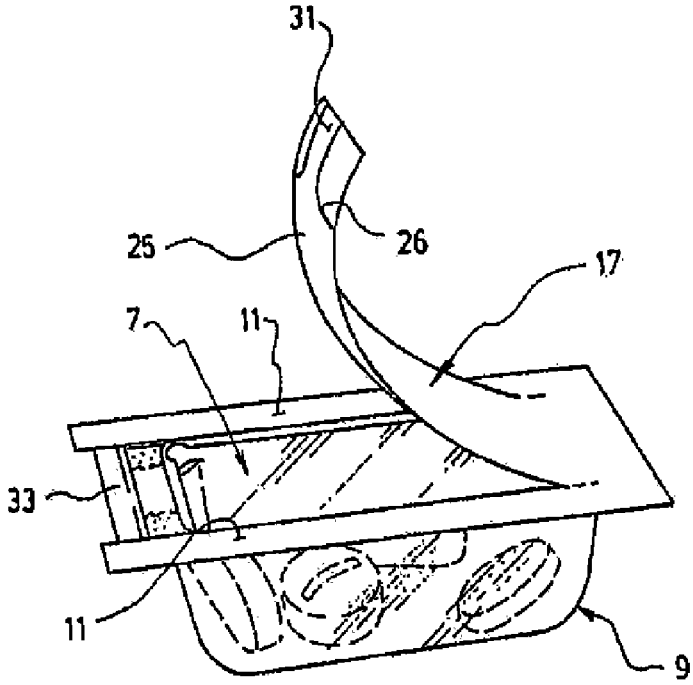
FIG. 2 is a perspective view of one of the containers of the set after this container has been detached and its sealing sheet has been opened.
Figure 3:
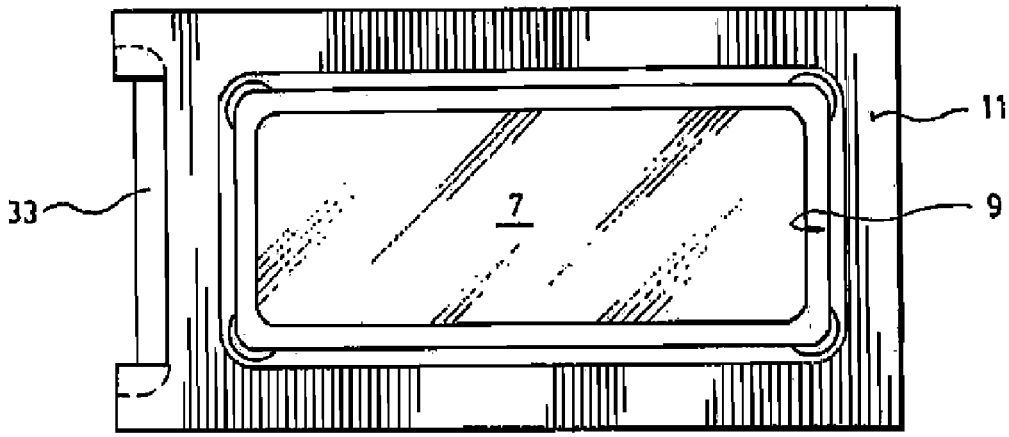
FIG. 3 is a top plan view of the container shown in FIG. 2.

As may be appreciated, these tearing lines 29 facilitate peeling of the bottom piece 25 and of the corresponding part of the cover piece 17 from the corresponding container and thus facilitate access to the elements stored therein, as such is shown in FIG. 2. More importantly, these other tearing lines 29 allow the remaining part of the sealing sheet 5 to remain glued onto the flanges surrounding each of the containers, even after the same have been opened (see FIG. 2). Such prevents that the pill(s) come(s) into contact with this glue by accident, which is of course something that must be avoided. Such also prevents the opened container from being closed again, which is something that can be done if the flanges still have some glue on their surfaces and the corresponding part of the sealing sheet may be folded back on them.

Figure 12:
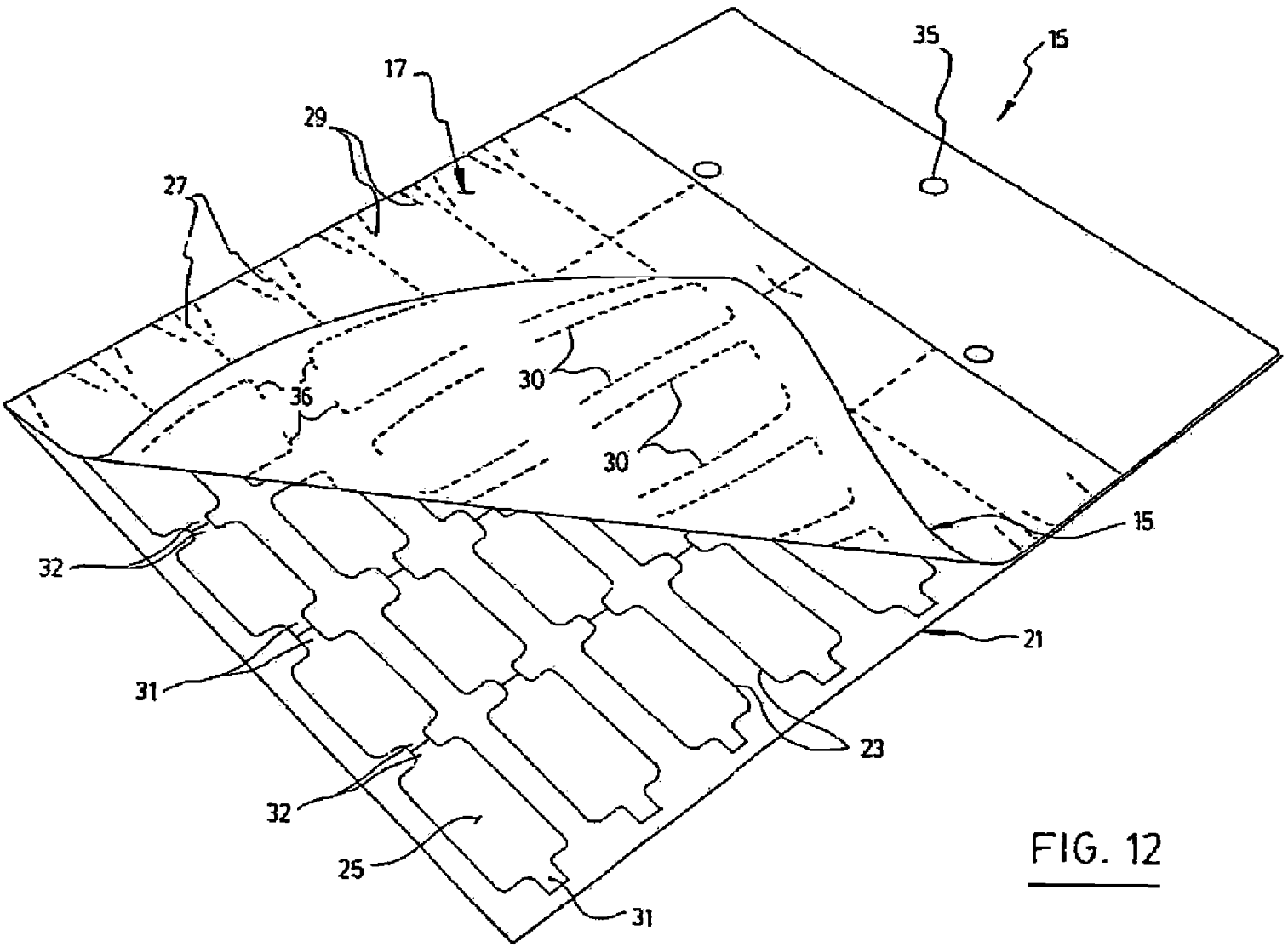
FIG. 12 is a perspective view showing the tearing lines punched by the teeth projecting from the first rolls of the machine shown in FIG. 9 on the upper surface of the top layer, and the tearing lines punched by the teeth projecting from the second rolls of the same machine on the lower surface of the top layer and the bottom layer of the sealing sheet.
Figure 13:
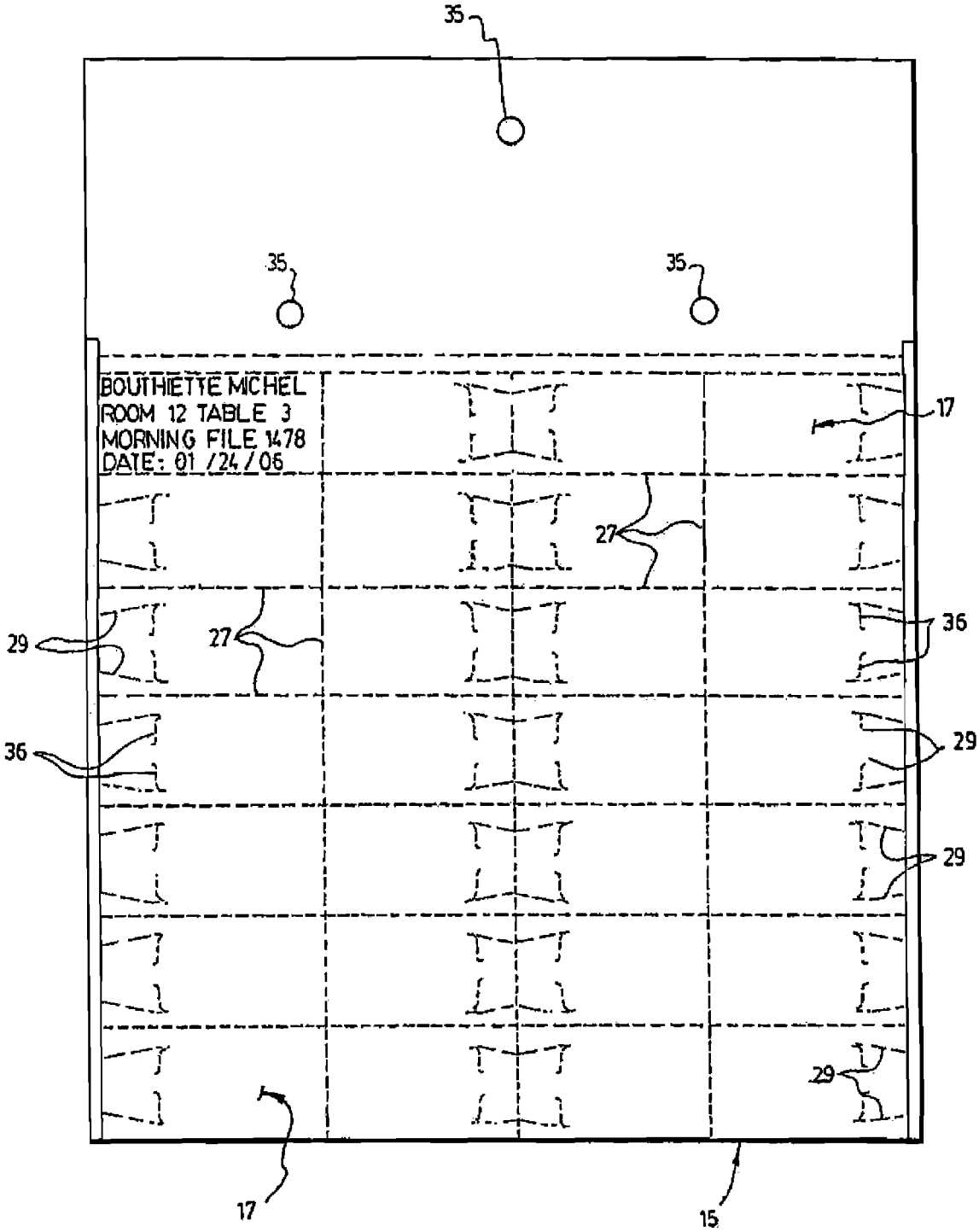
FIG. 13 is a top plan view of the top layer of the sealing sheet of an improved set of individual pill containers according to another preferred embodiment of the invention, the remaining components of said set being identical to those illustrated in the previous Figures.

As shown in FIG. 13, the tearing lines 29 of each pair may stop at the corresponding corners of the bottom piece 25. In such a case, peeling of the bottom piece 25 is achieved by ripping of the corresponding part of the cover piece 17, such a ripping usually extending along the opposite sides of the bottom piece 25. However, if needs be, each of the tearing lines 29 may be optionally provided with an extension 30 punched in the top layer 15 in such a manner as to extend further from the adjacent corner of the corresponding bottom piece 25 along one of the opposite sides of this bottom piece 25. Such optional extensions are illustrated in FIGS. 1 to 12.

In accordance with a preferred embodiment of the invention, the tearing lines 23 of the bottom layer 21 of the sealing sheet 5 are also devised so as to provide each of the bottom pieces 25 with a small pulling tab 31 projecting from one edge 26 of the bottom piece, hereinafter called "front edge", in such a manner that, once the sealing sheet 5 is glued on top of the container-defining sheet 3, this pulling tab 31 extends at a short distance away from the cavity 7 of the corresponding container 9 towards an adjacent recess 33 embossed therein. Such again advantageously facilitates peeling of the bottom piece 25 from the container 9.

As is shown in FIGS. 1 to 4 of the drawings, the recesses 33 are preferably U-shaped, so as to give easy access to a finger and thus facilitate such a peeling. Such substantially facilitates access to the content of each container 9, as compared to what was done so far.

Figure 8:
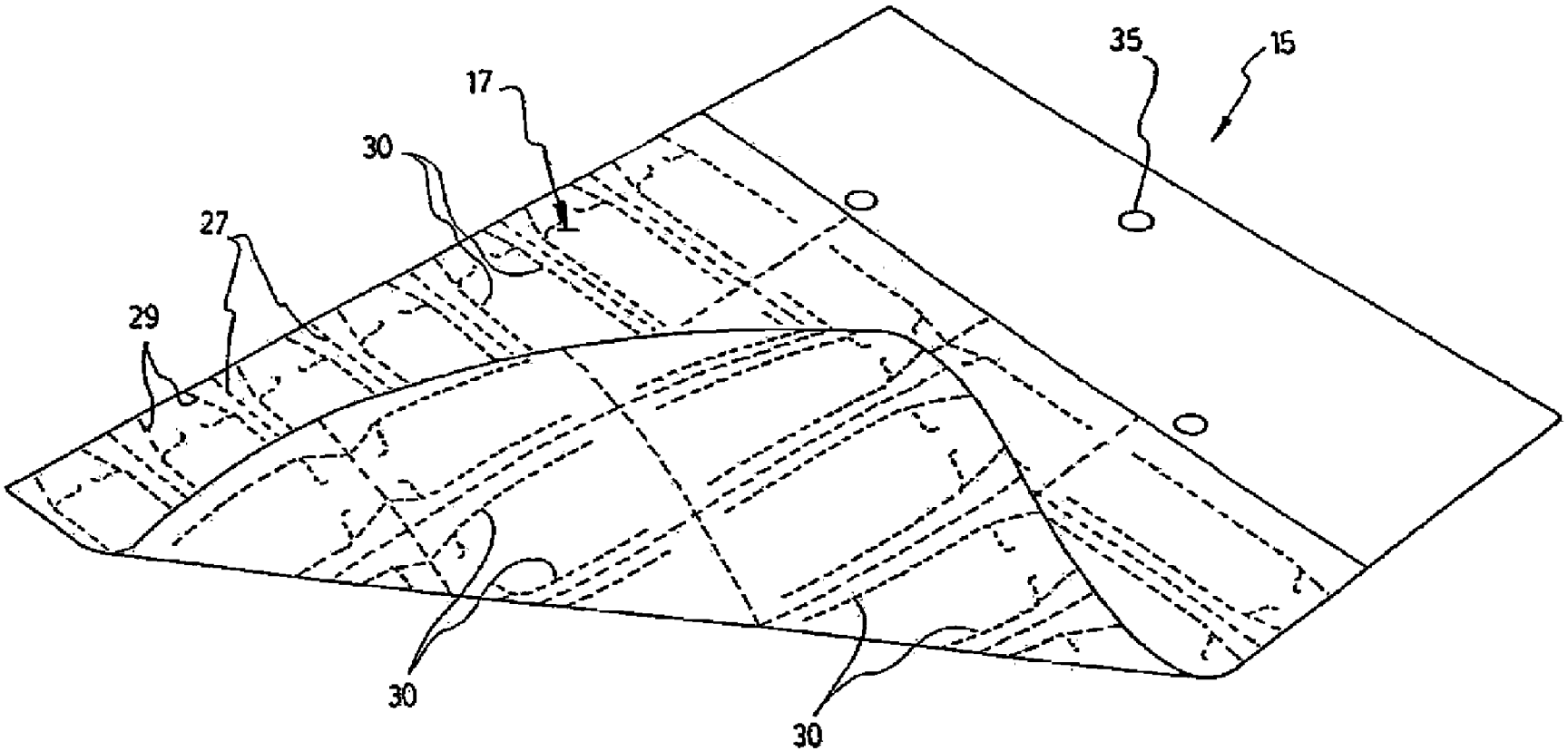
FIG. 8 is a perspective view of the top layer of the sealing sheet illustrated in the previous Figures, in a semi-folded position to see the tearing lines made on it.

In such a case, to make the peeling even more efficient, the top layer 15 of the sealing sheet may advantageously also have additional tearing lines 36 punched therein in such a manner as to extend toward the pulling tab punched therein along the front edge 26 of the bottom piece from which this pulling tab projects. As is shown in FIGS. 2 and 8, the additional tearing lines 36 extend transversally from the corners of the bottom piece 25 along the front edge 26 of it, towards and up to the pulling tab 31. Such makes the peeling of the bottom piece 25 easier, safer and much more efficient.

Preferably also, the lines 23 of the bottom layer of the sealing sheet 5 may be devised so as to provide each of the bottom pieces 25 with an extension 32 that is opposite to the front edge 26 from which projects the pulling tab 31. Such an extension 32 which may extend over the full width of the rear edge of the bottom piece 25 or over a portion only of said rear edge, as is illustrated, advantageously allows the rear end of the bottom piece 25 to remain attached onto the adjacent surface of the corresponding container 9 and thus to prevent inadvertent separation of the rear portion of the bottom piece 25 from the top layer 15 on which said bottom piece is glued, with the risk of inadvertent gluing of the pills stored in the container.

In the preferred embodiment illustrated in the accompanying drawings, which is a set for individual pill containers for use in the pharmaceutical field, the container-defining sheet 3 comprises twenty-eight containers that are positioned in order to define seven rows and four columns. The sealing 5 is devised to form a corresponding number of cover pieces 17 each of which can be printed with relevant information as to the content of the corresponding container, and the date and hour the pills contained therein must be taken.

Figure 7:
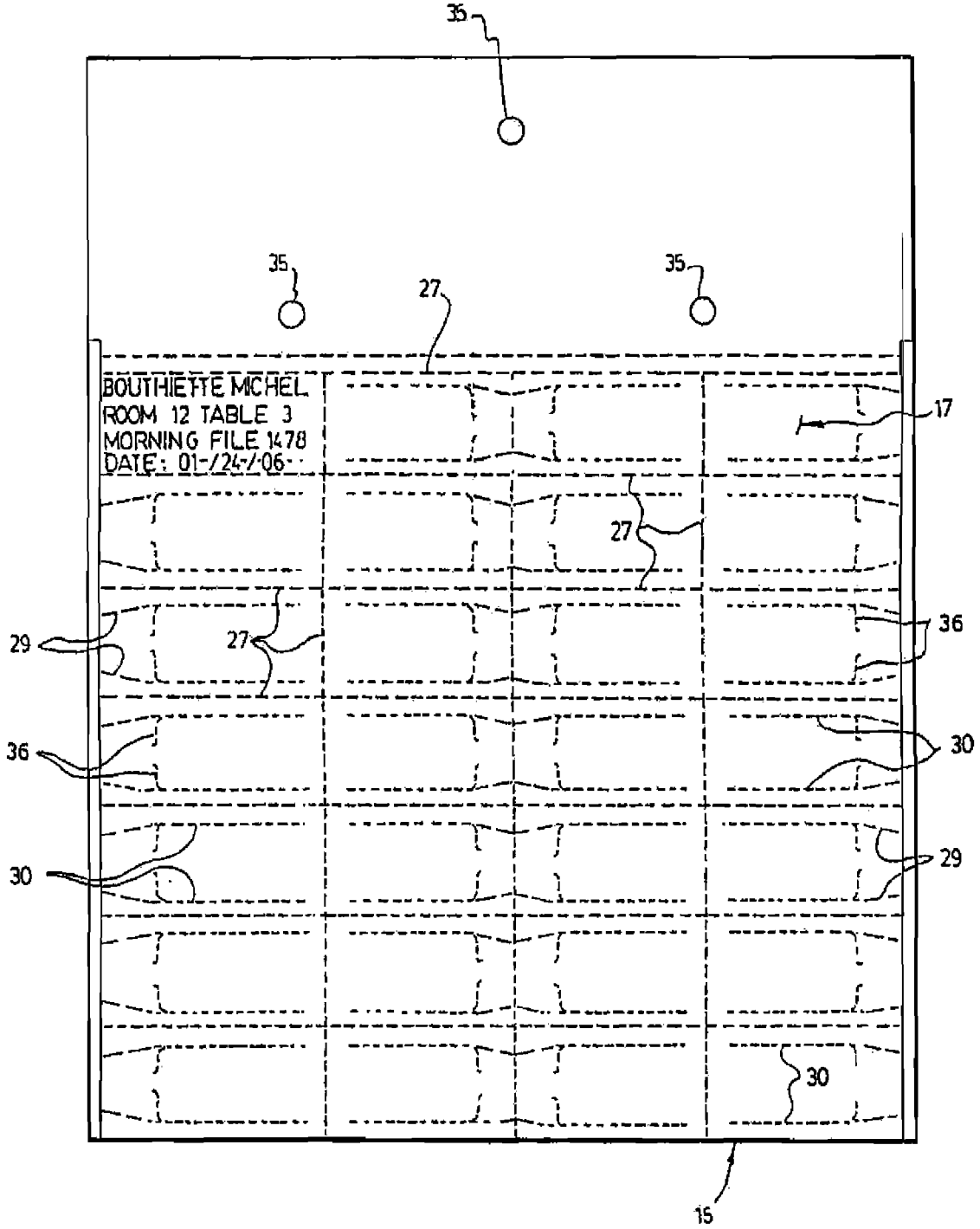
FIG. 7 is a top plan view of the sealing sheet illustrated in the previous Figures.

Such particular application is of course devised for use in the medical field, when pills and/or tablets must be administered every day at different periods of time. An example of such printing is illustrated in FIG. 7. As to the way such printing can be done and its advantage, reference can be made to U.S. Pat. No. 5,788,079 naming the present inventor, which has already been mentioned hereinabove.

Of course, it may be understood that, for other applications, the kind of printing and the number of containers may vary.

As also shown in the accompanying drawings, the sealing sheet 5 and the top surface of the container-defining sheet 3 are advantageously provided with positioning means such as holes 35 that may cooperate with pins extending from a recessed support (not shown) in order to ensure proper positioning of both of them with respect to each other during installation and exact superimposition of the bottom pieces 25 of the sealing sheet on top of the corresponding cavities 7 and with all the tearing lines of the top layer of the sealing sheet in alignment with the tearing lines of the container-defining sheet 3. As to the way such can be done, reference can again be made to U.S. Pat. No. 5,788,079.

Thus, it may be noted that the sealing sheet 5 according to the invention is very simple yet efficient in structure. It provides easy and safe access to the elements stored in the container-defining sheet 3 with a substantial reduction of the risk that such elements comes into contact with the glue used to attach the sealing sheet. Moreover, it is quite easy to manufacture and assemble.

Figure 9:
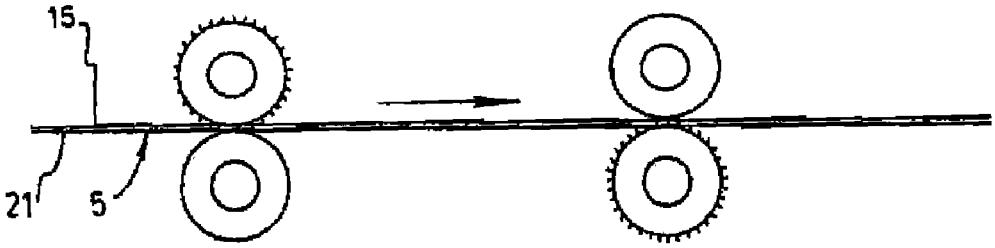
FIG. 9 is a schematic side elevational view of a machine for use to punch the tearing lines in the sealing sheet illustrated in the previous drawings.

The way the sealing sheet 5 can be manufactured is illustrated in FIGS. 9 to 12. Such a manufacture first comprises fixation of the bottom layer 21 on the lower surface of the top layer 15 by means of the adhesive glue. Thus, the sealing sheet 5 is fed into a machine for use to punch all the tearing lines mentioned hereinabove. This machine which is schematically illustrated in FIG. 9 comprises a first set of rolls provided with teeth whose purpose is essentially to punch the tearing lines 27 and part of the tearing lines 29 directly onto the upper surface of the top layer 15, is shown on top of this layer 15 in FIG. 12. It is worth noting here that the above mentioned tearing lines 27 and 29 are actually punched over the full height of the top layer 15, as is shown in all the other figures, wherein the tearing lines 27 and 29 are shown on both sides of the top layer.

The machine illustrated in FIG. 9 also comprises a second set of rolls provided with teeth whose purpose is essentially to punch all the tearing lines 23 of the bottom layer 21 of the sealing sheet as well as the other optional tearing lines 30 of the top layer 15 and the other optional tearing lines 36 of said top layer 15. Such is shown in FIG. 12.

Figure 10:
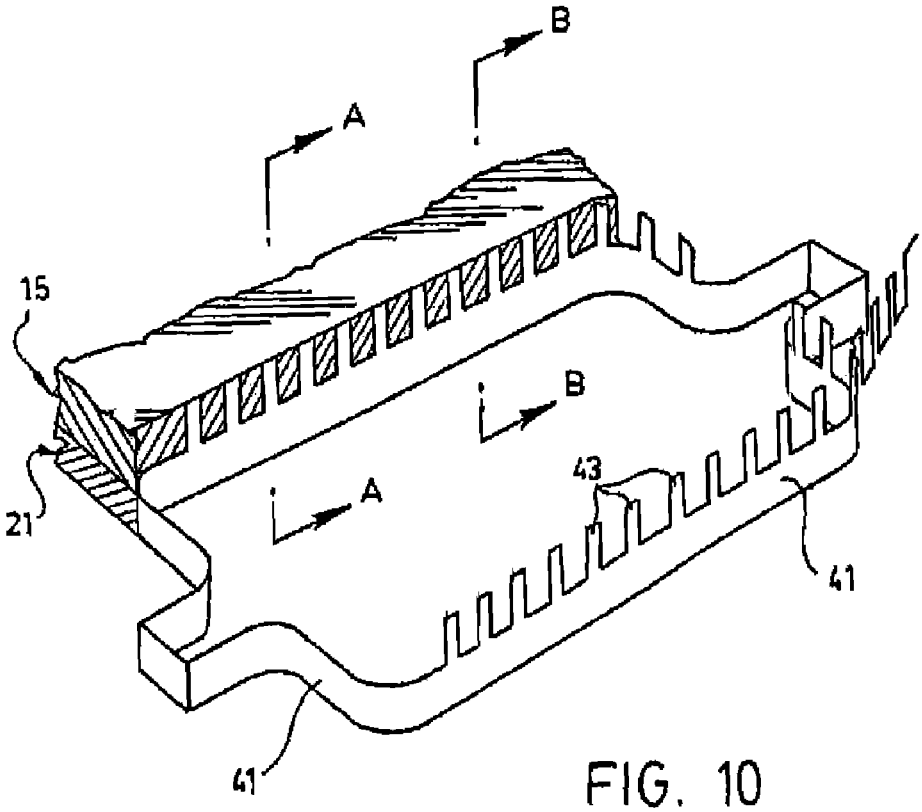
FIG. 10 is a perspective view of the teeth projecting from the second rolls of the machine shown in FIG. 9, which teeth are used to punch all the tearing lines of the bottom layer of the sealing sheet and part only of the tearing lines of the top layer of the same sealing sheet.
Figure 11A:
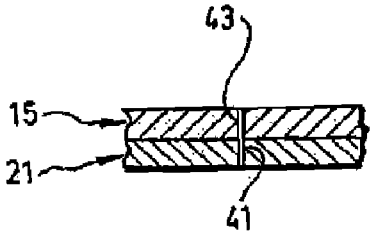
FIGS. 11 A and 11 B are cross-sectional views taken along lines A-A and B-B of the sealing sheet shown in FIG. 10.
Figure 11B:
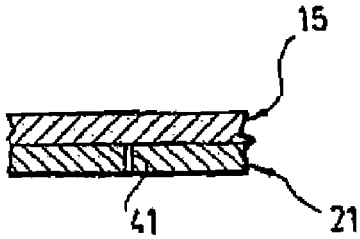

The kind of teeth used in the second set of rolls to achieve the above mentioned punching is illustrated in FIG. 10. As can be seen, these teeth include a continuous bottom projection 41 whose purpose is to punch the tearing lines 23 of the bottom layer 21 over the full height of it. These teeth also includes spaced a part top projections 43 whose purpose is to punch the tearing lines 29 and 36 over the full height of the top layer 15.

Figure 6:
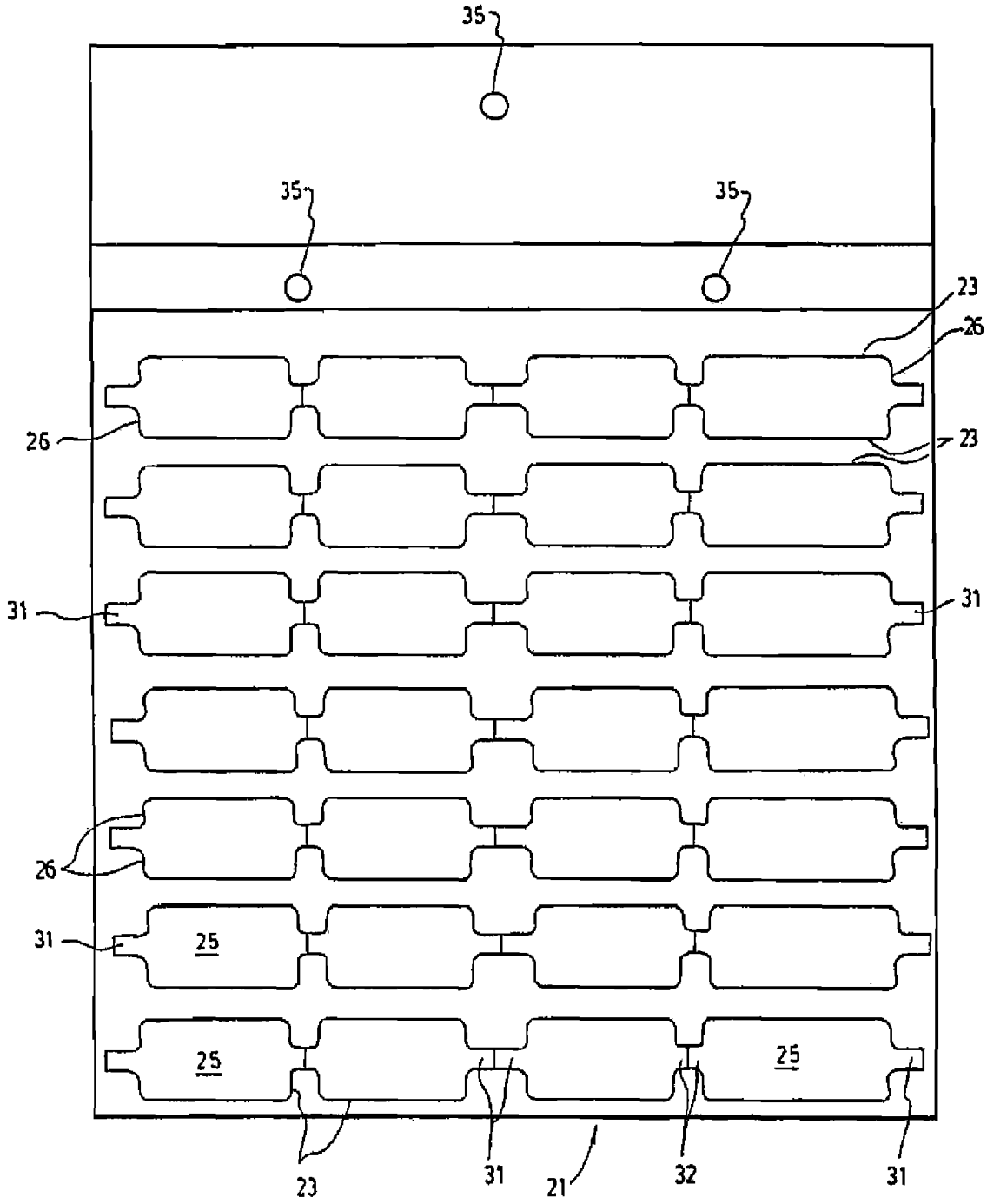
FIG. 6 is a bottom plan view of the sealing sheet illustrated in the previous Figures.

The sealing sheet 5 existing from the machine then has its top and bottom layers 15 and 21 punched as shown in FIGS. 6 to 8

As may be appreciated, numerous modifications could be made to the preferred embodiment disclosed hereinabove without departing from the scope of the present invention. In this connection, it is worth reminding that the present invention, even though it is particularly well adapted to the manufacture of sets of individual pill containers for use in the pharmaceutical field, it could be used in other fields for other applications. It may also be noted that the number of containers may vary from one application to another and the shape and size of each of the containers may be modified as requested.

The invention claimed is:

1. In a sealing sheet for use to close a container-defining sheet having a top surface comprising a given number of spaced apart cavities embossed therein, each of said cavities being upwardly opened and thus defining a container that is surrounded by a flange that is part of the top surface of said container-defining sheet, said sealing sheet comprising:

a top layer having an upper surface and a lower surface, said lower surface being covered with a pressure sensitive adhesive glue; and a bottom layer having an upper surface detachably fixed to the lower surface of the top layer by means of said adhesive glue, said bottom layer being peelable from the lower surface of the top layer to allow fixation of the sealing sheet onto the top surface of the container-defining sheet in order to close the containers defined in the same, said bottom layer having tearing lines punched into it in such a manner and position as to leave parts of said bottom layer glued onto the bottom surface of the top layer in the form of a number of bottom pieces equal to the given number of cavities made in the container-defining sheet when said sealing sheet is peeled off, each of said bottom pieces being shaped, sized and positioned so as to extend over a corresponding cavity of the container-defining sheet when the sealing sheet is properly applied to and glued on the flanges of the top surface of the container-defining sheet, said bottom pieces thus preventing any element stored in the containers from coming into contact with the adhesive glue, the improvement wherein the top layer of the sealing sheet has pairs of tearing lines punched therein, each of said pairs of tearing lines being adjacent to one of said cover pieces and having each of its tearing lines that extends from one side of said adjacent cover piece towards at least one adjacent corner of the bottom piece of said cover piece, in order to facilitate peeling of said bottom piece and of the corresponding part of the cover piece from the corresponding container and thus to have access to the element(s) stored in it.

2. The improved sealing sheet of claim 1, wherein each of the flanges that are parts of the top surface of the container-defining sheet and are not directly adjacent to one side of said container-defining sheet, are provided with a centrally positioned tearing line so as to make it possible to separate each of the containers from the adjacent containers and thus from the container-defining sheet whenever desired; and the top layer of the sealing sheet also have other tearing lines punched therein in such a manner and position as to be in line with the tearing lines of the container-defining sheet and thus to allow said top layer, once glued onto the flanges of the container-defining sheet, to be splitted into a number of cover pieces equal to the number of containers, such making it possible to detach each of said containers from the container defining sheet while keeping it closed.

3. The improved sealing sheet of claim 2, wherein:

the container-defining sheet comprises recesses embossed therein so as to extend adjacent to the one side of each of the cover pieces from which extend the tearing lines allowing peeling of the corresponding bottom piece from the corresponding container, said recesses being U-shaped so as to give easy access to a finger and thus facilitate such a peeling; and the tearing lines of the bottom layer of said sealing sheet are devised so as to provide each of the bottom pieces with a small pulling tab projecting from one edge of bottom piece, in such a manner that once the sealing sheet is glued on top of the container defining-sheet, said pulling tab extending at a short a distance away from the cavity of the corresponding container towards the adjacent recess embossed therein, such facilitating again peeling of said bottom piece from said container.

4. The improved sealing sheet of claim 3, wherein the top layer has additional tearing lines punched therein in such a manner as to extend toward the pulling tab along the edge of the bottom piece from where said pulling tab projects, said additional tearing lines extending transversally from the corners of the bottom piece along the edge of it, up to the pulling tab.

5. The improved sealing sheet of claim 4, wherein the tearing lines of the bottom layer of said sealing sheet are devised so as to provide each of said bottom pieces with an extension opposite to the edge from which projects the pulling tab.

6. The improved sealing sheet of claim 5, wherein:

the containers defined by the cavities of the container-defining sheet are positioned to form rows and columns; and the cover pieces splittable from the sealing sheet are similarly positioned so as to correspond to said rows and columns.

7. The improved sealing sheet of claim 6, wherein the sealing sheet and the top surface of the container-defining sheet are provided with positioning means to ensure proper positioning of both of them with respect to each other during installation and thus exact superimposition of the bottom pieces of the sealing sheet on top of the corresponding cavities, and exact superimposition of the tearing lines of the top layer of the sealing sheet with the tearing lines of container-defining sheet.

8. The improved sealing sheet of claim 7, wherein said positioning means consists of at least two spaced apart holes sized to fit onto pins projecting from a support.

9. The improved sealing sheet of claim 8, wherein the top surface of said sealing sheet comprises information printed on it in such a manner as to be positioned on top of each cover piece and thus to correspond to what is located in the corresponding container.

10. The improved sealing sheet of claim 9, wherein:

said sealing sheet is made of paper; and said container defining sheet is made of plastic material.

11. The improved sealing sheet of claim 10, wherein the upper surface of the bottom layer of the sealing sheet is covered with silicone.

12. The improved sealing sheet of claim 11, wherein:

the container-defining sheet is intended to store individual pills and comprises twenty-eight containers, said containers being positioned to define seven rows and four columns; and the sealing sheet is devised to form a corresponding number of cover pieces that are each printed with relevant information as to the content of the corresponding containers and the date and hour the pills contained therein must be taken.

13. The improved sealing sheet of claim 9, wherein the tearing lines of each of said pairs of tearing lines extend further from the adjacent corners of the corresponding bottom piece along the opposite sides of said corresponding bottom piece.

14. In a set of individual pill containers comprising:

a container-defining sheet made of plastic material, said container-defining sheet having a top surface comprising a given number of spaced apart cavities embossed therein, each of said cavities being upwardly opened and thus defining a container, each of said containers being surrounded by a flange, each of the flanges that are not directly adjacent to one side of the container-defining sheet being provided with a centrally positioned tearing line so to make it possible to detach each of the containers from the adjacent containers and thus from the container-defining sheet whenever desired, and a sealing sheet made of paper and positioned on top of the top surface of the containing-defining sheet in order to close each of said containers, said sealing sheet being shaped and sized to cover at least all its containers and their surrounding flanges, said sealing sheet being detachably attached to the container-defining sheet by means of a pressure sensitive adhesive glue and being provided with tearing lines positioned to be in superposition on top of the tearing lines of the container-defining sheet to make it possible to tear said sealing sheet into a number of cover pieces corresponding to the number of said containers and thus to detach each of said containers without having to open the same; said sealing sheet comprising:

a top layer made of paper and having an upper surface and a lower surface, said lower surface being covered with the pressure sensitive adhesive glue; and a bottom layer detachably fixed to the lower surface of the top layer by means of said adhesive glue, said bottom layer being peelable from the lower surface of the top layer to allow fixation of the sealing sheet onto the top surface of the container-defining sheet in order to close the containers of the same, said bottom layer having tearing lines punched into it in such a manner and position as to leave parts of said bottom layer glued onto the bottom surface of the top layer in the form of a number of bottom pieces equal to the given number of cavities made in the container-defining sheet when the sealing sheet is peeled off, each of the said bottom pieces being shaped, sized and positioned so as to extend over a corresponding cavity of the container-defining sheet when the sealing sheet is properly applied to and glued on the flanges on the top surface of said container-defining sheet, such bottom pieces preventing any element stored in the containers from becoming into contact with the adhesive glue;

the improvement wherein the top layer of the sealing sheet has pairs of tearing lines punched therein, each of said pairs of tearing lines being adjacent to one of said cover pieces and having each of its tearing lines that extends from one side of said adjacent cover piece towards at least one adjacent corner of the bottom piece of said cover piece, in order to facilitate peeling of said bottom piece and of the corresponding part of the cover piece from the corresponding container and thus to have access to the element(s) stored in it.

15. The improved set of individual pill containers of claim 12, wherein:

the container-defining sheet comprises recesses embossed therein so as to extend adjacent to the one side of each of the cover pieces from which extend the tearing lines allowing peeling of the corresponding bottom piece from the corresponding container, said recesses being U-shaped so as to give easy access to a finger and thus facilitate such a peeling; and the tearing lines of the bottom layer of said sealing sheet are devised so as to provide each of the bottom pieces with a small pulling tab projecting from one edge of bottom piece, in such a manner that, once the sealing sheet is glued on top of the container defining-sheet, said pulling tab extending at a short a distance away from the cavity of the corresponding container towards the adjacent recess embossed therein, such facilitating again peeling of said bottom piece from said container.

16. The improved set of individual pill containers of claim 15, wherein the top layer has additional tearing lines punched therein in such a manner as to extend toward the pulling tab along punched therein the edge of the bottom piece from where said pulling tab projects, said additional tearing lines extending transversally from the corners of the bottom piece along the edge of it, up to the pulling tab.

17. The improved set of individual pill containers claim 15, wherein:

the tearing lines of the bottom layer of said sealing sheet are devised so as to provide each of said bottom pieces with an extension opposite to the edge from which projects the pulling tab.

18. The improved set of individual pill containers of claim 17, wherein:

the containers defined by the cavities of the container-defining sheet are positioned to form rows and columns; and the cover pieces splittable from the sealing sheet are similarly positioned so as to correspond to said rows and columns; and the top surface of said sealing sheet comprises information printed on it in such a manner as to be positioned on top of each cover piece and thus to correspond to what is located in the corresponding container.

19. The improved set of individual pill containers of claim 18, wherein the tearing lines of each of said pairs of tearing lines extend further from the adjacent corners of the corresponding bottom piece along the opposite sides of said corresponding bottom piece.

20. The improved set of individual pill containers of claim 18 wherein:

the container-defining sheet is made of plastic material and comprises twenty-eight containers, said containers being positioned to define seven rows and four columns; and the sealing sheet is made of paper and is devised to form a corresponding number of cover pieces that are each printed with relevant information as to the content of the corresponding containers and the date and hour the pills contained therein must be taken.

* * * * *